United States Patent [19]

Gawad et al.

[11] Patent Number: 5,034,859

[45] Date of Patent: Jul. 23, 1991

[54] RECESSED FLUORESCENT LUMINAIRE HOUSING

[75] Inventors: Mahmoud A. Gawad; John Graudins, both of Montreal, Canada

[73] Assignee: GTE Products Corporation, Danvers, Mass.

[21] Appl. No.: 456,998

[22] Filed: Dec. 26, 1989

[51] Int. Cl.[5] ..... F21K 2/00; F21S 3/02

[52] U.S. Cl. ..... 362/26; 362/147; 362/217; 362/364

[58] Field of Search ..... 362/260, 217, 223, 330, 362/364, 148, 147

[56] References Cited

U.S. PATENT DOCUMENTS

| | | | |
|---|---|---|---|
| 2,829,244 | 4/1958 | Feig et al. | 362/364 |
| 3,038,771 | 6/1962 | Schwartz et al. | 362/128 X |
| 4,368,506 | 1/1983 | Rapp | 362/147 |
| 4,868,727 | 9/1989 | Ponds et al. | 362/223 X |
| 4,907,138 | 3/1990 | Brueggemann et al. | 362/217 X |

*Primary Examiner*—Stephen F. Husar
*Assistant Examiner*—Peggy Neils
*Attorney, Agent, or Firm*—William E. Meyer

[57] ABSTRACT

A recessed fluorescent luminaire housing is described wherein the housing is formed from one piece with included coupling elements to permit quick assembly. The design provides flexibility for model changes without the need to redesign the main luminaire housing. The luminaire housing is made from a single piece sheet metal blank. The diffuser panel frame is made from two sheet metal blanks.

10 Claims, 6 Drawing Sheets

RECESSED FLUORESCENT LUMINAIRE HOUSING

TECHNICAL FIELD

The invention relates to electric lamp fixtures and particularly to fixtures for fluorescent lamps. More particularly the invention is concerned with a recessed fluorescent lamp fixture formed from a single piece housing.

BACKGROUND ART

It is common practice to make recessed fluorescent luminaires from several components. A housing may be commonly formed from two separate ends, four separate frame sides, two hinges, two latches, and numerous fasteners. These parts are manually assembled into a complete luminaire using screws, rivets or other fasteners. Since assembly costs rise with the number of components, there is a need for a luminaire with a minimum number of components.

It is also common practice, to make luminaires with at least two different housings forms. One form is for recessed ceiling mounting, while a second is for recessed dry wall mounting. The application of a single or a three lamp version in place of the more common two lamp and four lamp versions usually requires additional different housing forms.

The disadvantages of the present common practice is the necessity to manufacture many parts and the need to assemble these parts together in various steps and the need to fasten the parts together by using mechanical fasteners, all of which is time consuming and expensive. There is then a need for a lamp fixture incorporating fewer parts to be assembled together for both the luminaire housing and frame.

There is also a need for a luminaire wherein a small change or addition of a component in the same housing may eliminate the need for a special housing thus providing flexibility for use.

Examples of the prior art are shown in U.S. Pat. Nos. 4,171,535; 4,403,275; 4,536,830. U.S. Pat. No. 4,171,535 shows a recessed, multiple piece fluorescent lamp luminaire having side walls designed to coact with a suspended ceiling structure. U.S. Pat. No. 4,403,275 shows recessed fluorescent lamp luminaire with an internal reflector structure to enhance light radiation. U.S. Pat. No. 4,536,830 shows a fluorescent lamp with an internal reflector structure to enhance illumination.

DISCLOSURE OF THE INVENTION

A recessed fluorescent luminaire housing may be form from a single piece housing blank having an inside surface and an opposite outside surface, further including a rectangular back panel having in sequence a first, second, third and fourth edge with the first edge and third edge being parallel and on opposite sides of the back panel, and the second edge and fourth edge being parallel and on opposite sides of the back panel, first, second, third, and fourth, substantially rectangular, side panels, coextensively coupled with the back panel along the respective first, second, third and fourth edges, the first side panel having first width edge, and the second side panel having a second width edge adjacent the first side panel along the first width edge, a first coupling means formed in the first side panel along the first width edge, a second coupling means formed in the second side panel along the second width edge, so located to couple with the first coupling means of the paired first width edge, the side panels being folded along the respective back panel edges toward the inside surface of the back panel to form an angle to the back panel, and couple the adjacent first coupling means and second coupling means one to another, and the remaining adjacent side panel pairs being folded towards the inside surface of the back panel, and coupled along adjacent free edges of the adjacent side panels to define a partially enclosed volume useful as a luminaire housing. The single piece housing greatly reduces manufacture cost, while allowing simple adaptations to varying final uses.

BEST MODE FOR CARRYING OUT THE INVENTION

Figure 1:
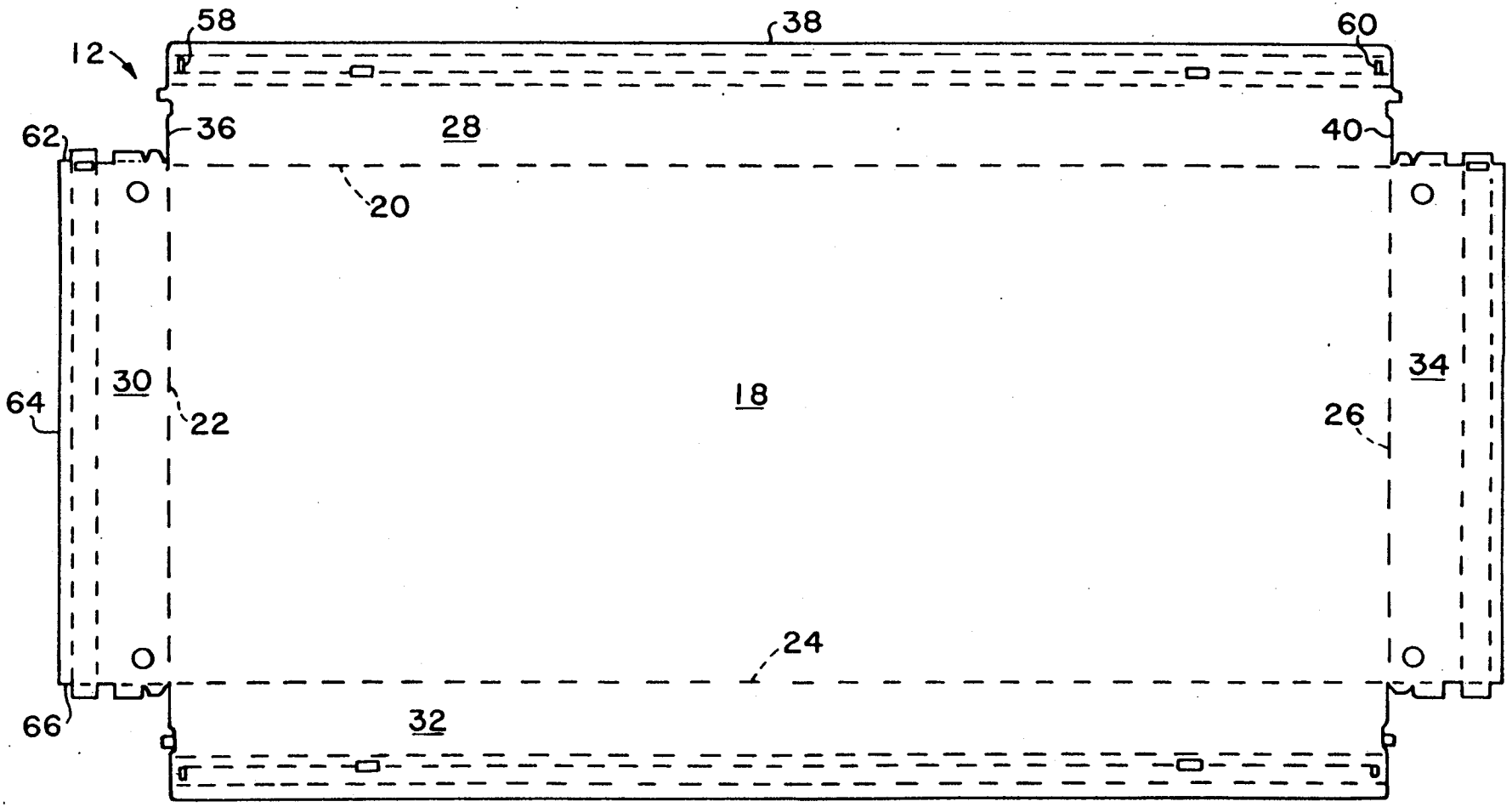
FIG. 1 shows a preferred embodiment of a sheet metal blank for a recessed fluorescent luminaire housing.
Figure 5:
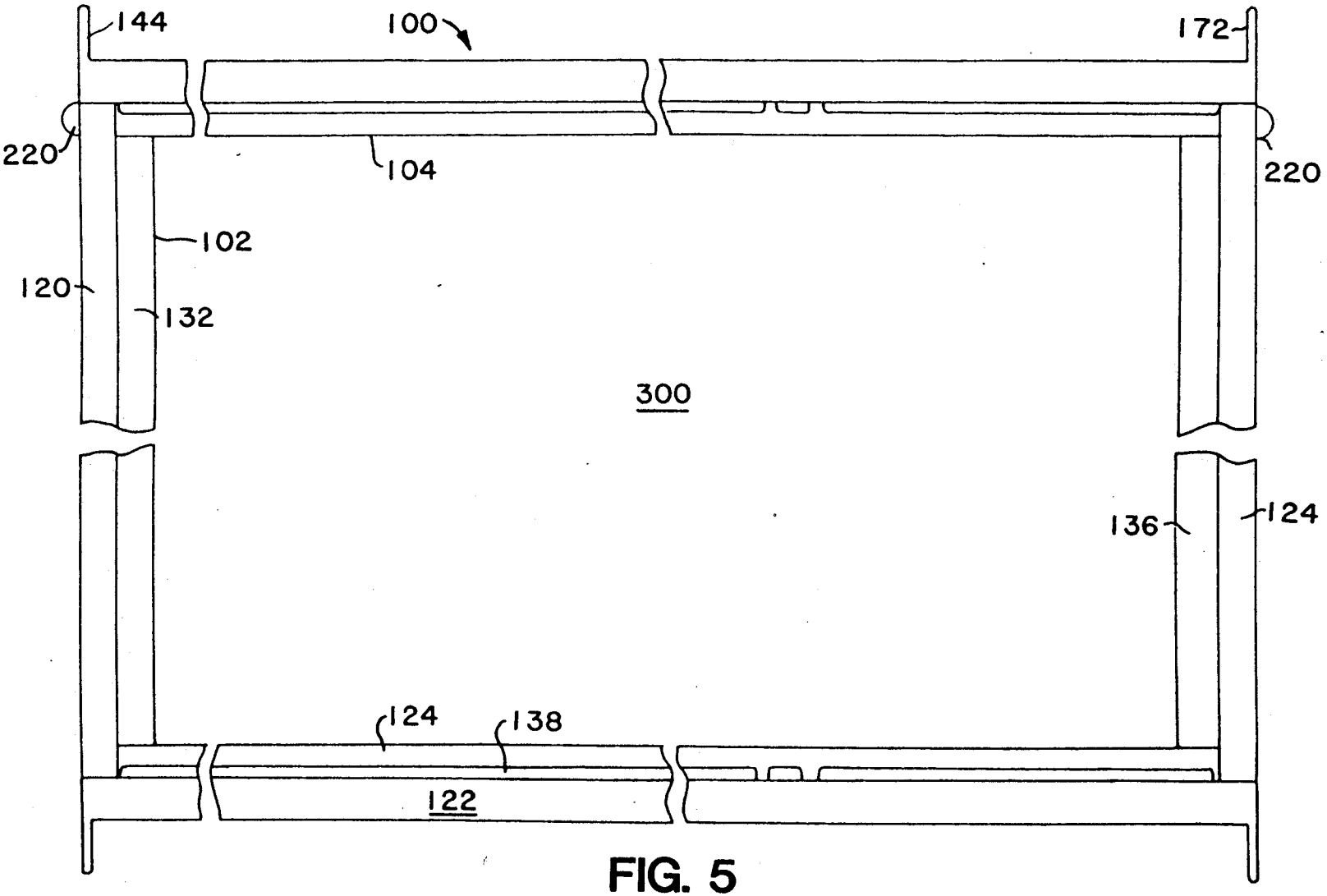
FIG. 5 shows a top view of a preferred embodiment of a recessed fluorescent luminaire diffuser panel frame.

The preferred embodiment of a recessed fluorescent luminaire is formed from a housing 12, a frame 100, and a window panel 300. FIG. 1 shows a preferred embodiment of a for a recessed fluorescent luminaire housing 12. The housing 12 may be formed from a single piece of sheet metal. The housing 12 may be folded together and, locked by a coupling structure, such as tabs formed as part of the housing 12 and extending through slots provided in the end panels. The frame 100, FIG. 5, is similarly formed from two parts, a single piece U shaped element 102, and a cross bar 104 coupled across the arms of the U shaped element 102 leaving exposed frame ends 144, 172. The housing 12 and frame ends 144, 172 are structured to coact as a hinged pair. The frame 100 further positions and supports the window panel 200 to enclose the included light sources.

The housing 12 is formed from a single piece of sheet metal. The housing 12 includes a rectangular back panel 18 having four sides 20, 22, 24, and 26. Coextensive and adjacent along opposite sides 20, 24 are two generally parallel, rectangular side panels 28, 32. Coextensive and adjacent along the remaining opposite sides 22, 26, and generally extending transversely to the side panels 28, 32 are two generally parallel rectangular end panels 30, 34.

Figure 2:
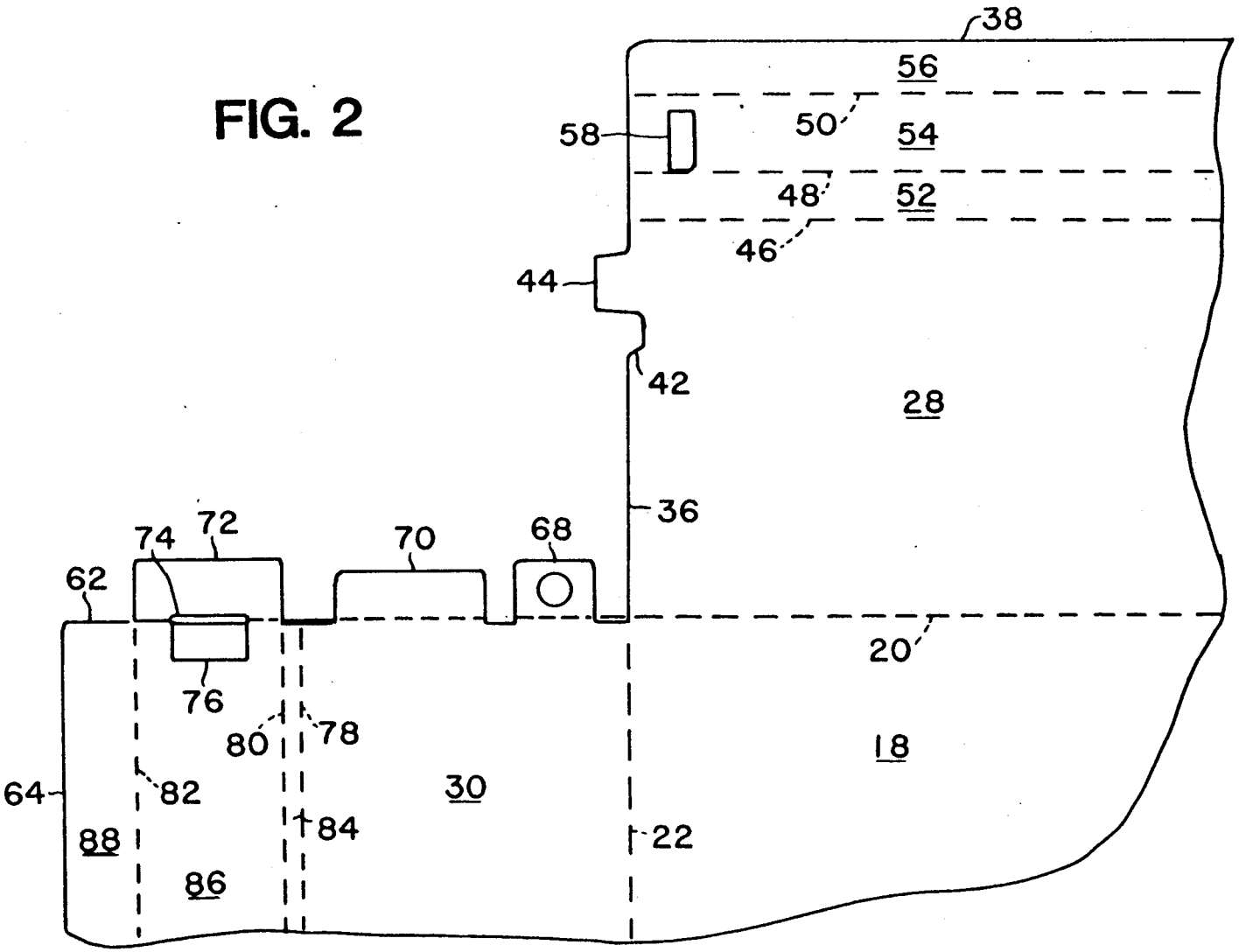
FIG. 2 shows a corner detail of the preferred blank.

Adjacent, and coextensive with the back panel 18 along side 20 is the first rectangular side panel 28. Side panel 28 has three remaining sides 36, 38, and 40. Turning now to FIG. 2, perpendicular to the side 20 at one end is a second side 36 that extends for a straight section, then angles along a notch 42 towards the side panel 28 for a short distance, and then angles again to parallel the first straight section of 36. Formed along the side 36 is then a formed insert tab 44. Running parallel to the side 20, near the opposite side 38, the preferred embodiment further includes three fold lines 46, 48, 50, thereby defining three subpanels 52, 54, and 56 within the side panel 28. In sequence, starting from side 20, there is in order an upper lip panel 52, a pivot panel 54, and a lower lip panel 56. Within the perimeter of the first side panel 28, near the intersection of side 36 and side 38 is a first latch opening 58 to receive a first latch end 144 of the frame 100. The preferred opening is a rectangular hole within a frame 100 edge widths of side 36, having one edge close to or colinear with fold line 48 and otherwise located within the perimeter of the pivot panel 54.

The side panel 28 is similarly formed along the opposite end, along side 40. Also, within the perimeter of the first side panel 28, near the end of the third side 38, and in the preferred embodiment within the perimeter of the same pivot panel 54, is a similar, second latch opening 60 to receive a second latch end of the frame 100. The preferred second opening 60 is again a rectangular hole within a frame width of side 40, having one edge close to or colinear with fold line 48 and otherwise located within the perimeter of the pivot panel 54.

On the opposite side of back panel 18 is a similarly formed second side panel 32, having similarly formed and positioned sides, tabs, subpanels, openings and other features as on the first side panel 28. The side panels 28, 32 are then mirror images of each other. While it is only necessary for there to be latch openings 58, 60 formed on one of the side panels, by forming the latch openings on both sides of panels 28, 32 allows the frame 100, and window panel 200 to be hinged to either side of the housing 12.

At a remaining side of the back panel 18, along a side 22 perpendicular to the first side 20 and the opposite third side 24 is a first end panel 30. The first end panel 30 is a rectangular panel having one side 22 adjacent, and coextensive with the back panel 18. The first end panel 30 has three remaining sides 62, 64, and 66. Parallel with side 20 and perpendicular to side 22, first end panel 30 is the first side 62. Formed along side 62, starting from the intersection of sides 20 and 22 are a first tab 68, a second tab 70, and a slotted tab 72. Centered in slotted tab 72 and colinear with side 62 is a slot 74 sized to snugly receive insert tab 44. In the preferred embodiment, slotted tab 72 is adjacent an embossed depression 76 sized and shaped to accommodate insert tab 44. Running parallel to the side 22, the preferred first end panel 30 further includes three fold lines 78, 80, and 82, thereby defining three subpanels, a notch panel 84, a slotted tab panel 86, and an upper lip panel 88 within the first end panel 30. The end panel 30 is similarly formed with tabs, slots and other features along the opposite end, along side 66.

On the opposite side of back panel 18 along side 26 is a similarly formed second end panel 34, having similarly formed and positioned sides, tabs, subpanels, slots and other features as on the first end panel 30. The end panels 30, 34 are then mirror images of each other.

To assemble the housing 12, the first and second side panels 28, 32 are folded 90° in the direction of the inside surface of the back panel 18. The first upper lip panel 52 is folded 90° to the first side panel 28, away from the back panel 18 to approximately parallel the back panel 18. The pivot panel 54 is folded 90° to the first upper lip panel 52, to approximately parallel the first side panel 28. The lower lip panel 56 is folded 90° to the pivot panel 54, away from the back panel 18 to approximately parallel the back panel 18. The corresponding panels of the second side panel 32 are similarly folded.

The first and second end panels 30, 34 are then folded 90° in the direction of the inside surface of the back panel 18. The notch panel 84 is folded to angularly match with the notch 42. The slotted tab panel 86 is folded to sit flush with the sections of side 36 adjacent the insert tab 44. The upper lip panel 88 of the first end panel 30 is folded 90° to the slotted tab panel 86 toward the inside surface of the back panel 18 to approximately parallel the back panel 18.

Figure 3:
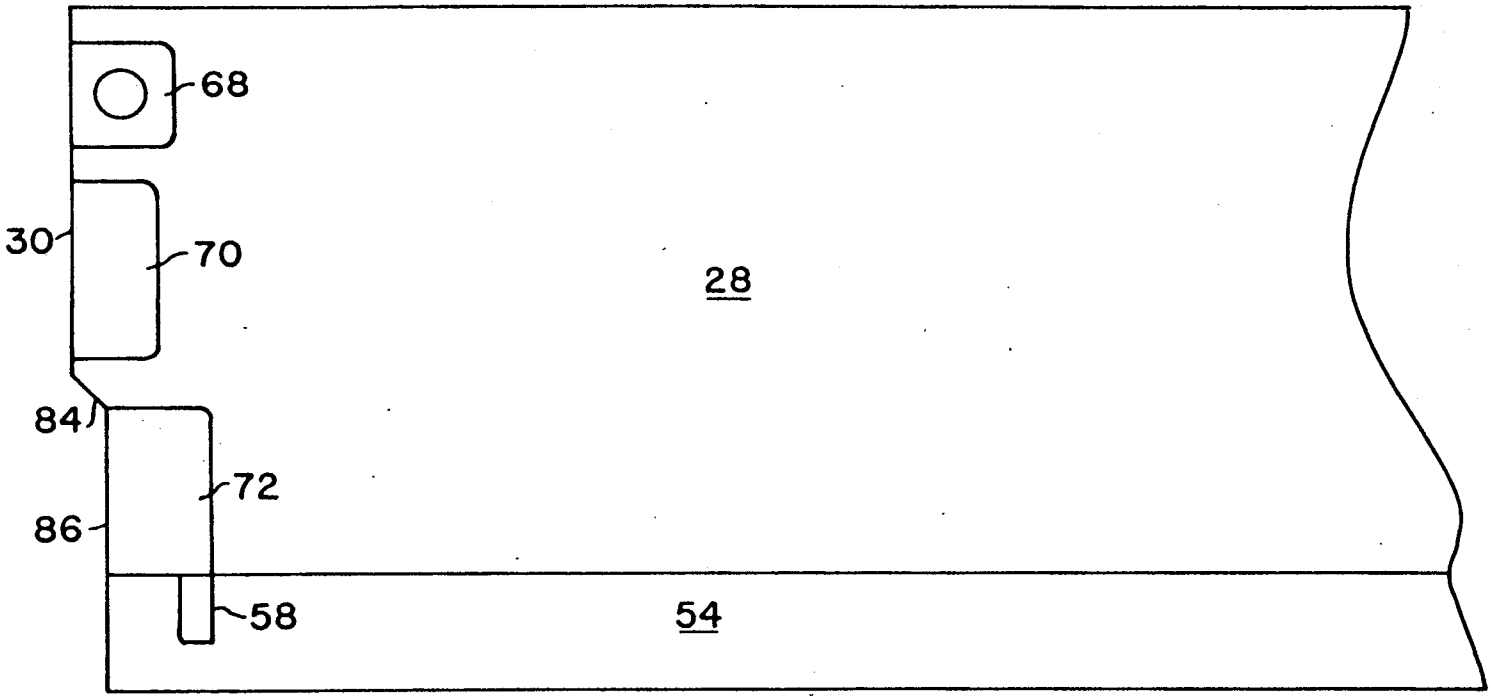
FIG. 3 shows an end sectional view of a side of the preferred luminaire.
Figure 4:
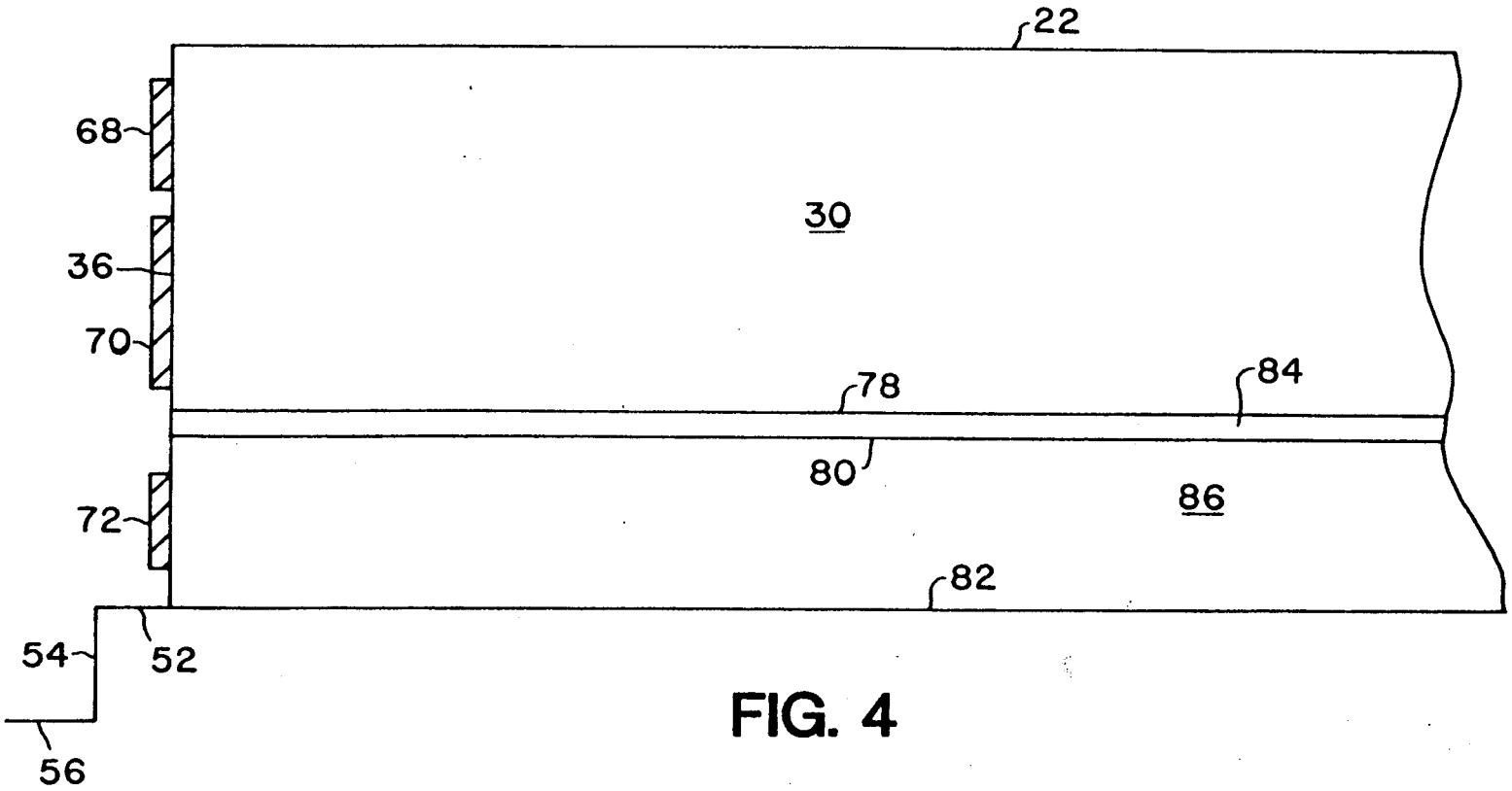
FIG. 4 shows an end sectional view of an end of the preferred luminaire.

Folding up the end panels 30, 34, causes the four respective insert tabs (44 and similar) of the two respective side panels to be threaded through the corresponding slots (74 and similar) of the corresponding two respective end panels. The four respective insert tabs (44 and similar) are then folded 90° to toward the respective slotted tab panel (86 and similar) to be positioned, in the preferred instance, in the respective tab depression (76 and similar). The insert tabs on the side panels then hook around to be adjacent the end panels, and to hold the end panels in place. The first tab 68, second tab 70 and slotted tab 72 of the respective end panels are then folded 90° towards the respective side panels 28. The respective first and second tabs separately hold and position the corresponding side panels The folded over slotted tabs perform a similar function, but additionally, in the preferred instance, the inside ends of the slots (74) fit snugly with the insert tabs (44) and lock the respective insert tabs (44) from moving transversely. The insert tabs (44) and slotted tabs (72) then form a mutually locked coupling that prevents the side 28 and end 30 panels from bending away from the inside surface of the back panel 18, bending away from each other, or from moving either transversely or parallel with respect to the seams formed between the sets of respective adjacent panel pairs. FIG. 3 shows a side view of the completed housing corner structure. FIG. 4 shows an end view of the completed housing corner structure.

Figure 6:
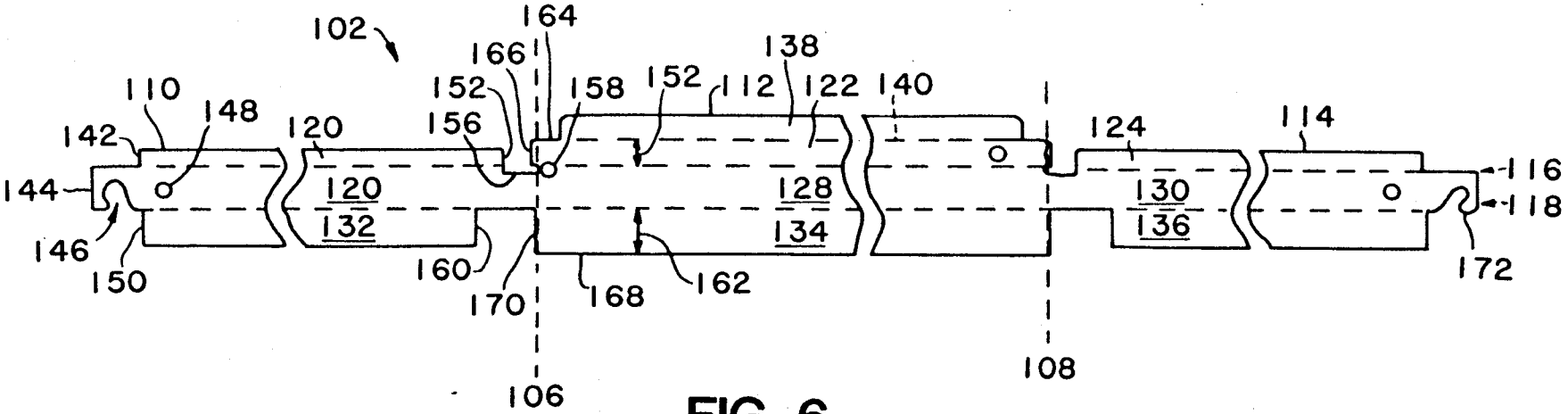
FIG. 6 shows a preferred embodiment of a sheet metal blank for the U shaped element of a diffuser panel frame, partially broken away.

Turning to FIG. 5, the frame 100 is formed from a single three sided U shaped element 102, and a single piece cross bar 104 linked across the open ends of the U shaped frame element 102. Turning to FIG. 6, the U shaped frame element 102 is divided perpendicular to its length by a first fold line 106 and a second fold line 108 into three subsections corresponding in sequence to the first end 110, first side 112 and second end 114 of the housing. The cross bar 104 corresponds to the second side of the housing. The U shaped frame 102 element is further divided lengthwise by at least a first parallel fold line 116 and a second parallel fold line 118 dividing the U frame subsections lengthwise into respective top panels 120, 122, 124, middle panels 126, 128, 130, and bottom panels 132, 134, 136. In the preferred embodiment, the first side 112 frame further includes a refractory lip panel 138 separated from the first side 112 frame top panel 122 by a fold line 140. Similar refractory lip panels may be formed on the frame end top panels 120, 124, if so desired.

The top, middle and bottom panels of the ends and sides are additionally cut out to be formed along the first fold line 106 and second fold line 108 to allow the adjacent panels to be positioned at 90° with respect to each other, and form a resilient structure to hold the panels at right angles to each other. The two right angle corners are similarly formed, so only one is described in detail.

The first frame end top panel 120 has a square end 142. The first frame end middle panel 126 has a protruding hook 144. The hook 144 includes an opening 146 along the lower edge, and is otherwise shaped to be inserted in one of the latch openings 58, 60, so the inner edge of the hook rests against the lower edge of the latch opening. The first frame end middle panel 126 further includes a rivet hole 148 or similar coupling feature near the hook 144. The first frame end bottom panel 132 has squared end 150 approximately colinear with squared end 142. The opposite end of the first frame end top panel 120 may be squared off 152 perpendicular to the parallel fold lines 116, 118. The first frame end top panel 120 in the preferred embodiment ends with an end face 152 at a distance from the first fold line 106 equal to the width 154 of the first frame side top panel 122.

The frame end middle panel 126, opposite the hooked end 144, in the preferred embodiment, extends uninterrupted as a single piece across the first fold line 106 to the first frame side middle panel 128. The first end middle panel 126, on the side adjacent the frame end top panel 120 in the preferred embodiment includes a notch 156. The notch 156 extends from the end of the first frame end top panel 120, to just beyond the first fold line 106. The notch 156 has a width 158 approximately equal to the thickness of the sheet metal used for the frame 100. The frame end middle panel 126 extends along the second parallel fold line 118 to the frame side middle panel 128. In an alternative embodiment, a similar notch structure, 156, may be formed along the lower parallel fold line 118 between the end point of the frame end bottom panel 132 and the first fold line 106.

The frame end bottom panel 132 has a squared off end 160, ending in the preferred embodiment at a distance 162 from the first fold line 106 equal to the width 162 of the frame side bottom panel 134.

The frame side top panel 122, in the preferred embodiment, includes an exposed top portion 164, having a shape complementary with the end face 152 of the first frame end top panel 120. The preferred complementary top faces 152, 164 are square for simplicity. Locking complementary portions may be used in the alternative. The frame side top panel 122, in the preferred embodiment, further includes a tab 166 extending across the first fold line 106, in the direction of the first frame end top panel 120. The tab 166 for simplicity is rectangular.

The frame side middle panel 128 is substantially coupled along the first fold line 106 to the first frame end middle panel 126. The notch 156, adjacent the upper fold line 118, interrupts the otherwise complete coupling between the two middle panels 126, 128.

The frame side bottom panel 134, in the preferred embodiment, includes an exposed bottom portion 168, having a shape complementary with the end face 160 of the first frame end bottom panel 132. The preferred complementary bottom faces 160, 168 are square for simplicity. Locking complementary portions may also be used in the alternative. The frame side bottom panel 134, in the preferred embodiment, further has a squared off end 170 coterminous with the first fold line 106. In the alternative, the side frame bottom panel 134 may include a tab portion, similar to the tab 166 portion of the top panel 122.

Figure 7:
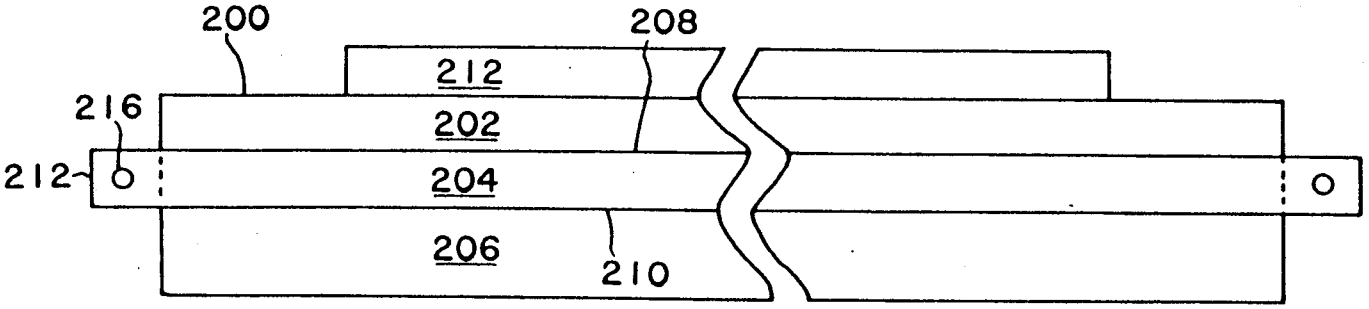
FIG. 7 shows a preferred embodiment of a sheet metal blank for a cross bar element of a diffuser panel frame, partially broken away.

Turning to FIG. 7, the cross bar blank 200 includes a top panel 202, a middle panel 204, and a bottom panel 206 separated by a first parallel fold line 208 and second parallel fold line 210 similar the structure of the first frame side panel 110. In a similar fashion, the cross bar 200 may include a refractor lip panel extend along the top panel 202. Extending from the ends of the cross bar middle panel 204 is a cross bar tab 214. The cross bar tab 214 includes a hole 214. The opposite end of the cross bar blank 200 may be similarly formed.

To assemble the frame 100, the top panels 120, 122, 124 are folded 90° to the middle panels 126, 128, 130 along the upper parallel fold line 116. In a similar fashion, the bottom panels 132, 134, 136 are folded 90° to the middle panels 126, 128, 130, to be on the same side as the now folded top panels. The frame 100 now has the general form of a U shaped bar with two notched portions adjacent the first fold line 106 and second fold line 108. The first frame end 102 is folded 90° toward the first frame side 104 to bring the adjacent complementary top panel faces 152, 164 and complementary bottom panel faces 160, 168 into adjacency. The respective complementary top and bottom faces abut one another and prevent further bending of the first frame end 102 with respect to the first frame side 104. The tab 166 of the first frame side top panel 122 extends across the notch 156 formed in the top edge of the first frame end middle panel 126. The overhanging tab 166 is bent 90° to toward the first frame end middle panel 126. The tab 164 then hooks behind the first frame end 102 to hold the first frame end 102 in 90° abutment to the first frame side 104. The first frame side 104 and second frame end 106 are similarly assembled to form a completed U shape frame element 102. If there are refactor lip panels 138, at an appropriate time, they are bend at an angle less than 90° away from the cavity of the U shaped frame element 102.

The cross bar 200 is similarly formed with the top, middle and bottom panels 202, 204, 206 bent at 90° to form a U shaped bar. The cross bar tabs 212, 216 are bent toward the U shaped cavity to be at 90° to the cross bar middle panels 204. The cross bar 200 is then fitted to the U shaped frame element 102 so the top, middle and bottom panels are adjacent, and the holes in frame end middle panels 148 and the cross bar tab holes 216 are aligned. Rivets 220, or other similar means are used to couple the U shaped frame element 102, and cross bar 104 through the aligned holes 148, 216. The two frame ends, the first frame side and the cross bar 104 then form a rectangular structure with a U shaped cross sections The refractory lip panels, if any, extend upwards at an angle to the rectangular frame, while the top frame panels form an opening greater than the opening formed by the adjacent bottom frame panels. A refractor panel 300, such as a plastic sheet with formed lenticules, or lens elements may be inserted through the larger upper opening defined by the four respective top panels, and not pass through the smaller lower opening defined by the four respective bottom panels. The frame 100 thereby supports the inserted refractor panel 300. Extending parallel to the frame ends 102, 106, away from the cross bar 200 are the two hook ends 144, 172. The hood ends 144, 172 may be inserted in the latch openings 58, 60, so the hooks 144, 172 are captured in the latch openings. The frame 100 may then hang from the latch opening edges by the hook ends 144, 172. The frame 100 may be rotated on the hooks 144, 172 up to the housing 12. The frame top panels 120, 122, 124, 202 are then brought into abutment with the upper lip panels 52, 88, thereby positioning the frame 100 in close alignment between the pivot panels 54, and adjacent the lip panels 56. A latch mechanism of appropriate design may be installed on the first frame side panel 128, and one or both of the pivot panels 54. The preferred latch is a plastic snap in hook that may be coupled to the first frame panel 104 by inserting a pivot into a hole formed in the first frame side panel 128. The frame 100 panel, and the supported refractor panel 300 may then be latched in place adjacent the housing 12. The housing 12 may be further equipped with fluorescent tube couplings, appropriate electronic controls, such as starting, and ballasting equipment, and appropriate electrical wiring and connection features as are known in the art. Fluorescent tubes may then be mounted for operation in the single piece housing, and be accessible through the frame hinged on the hooks.

The method of construction provides a rigid single piece luminaire housing not requiring fasteners. The frame may be made of only four parts, a U shaped frame element, a cross bar and two latches (not shown). The hinges are formed as a longitudinal extensions of the frame, such as hooked ends ends permitting the extensions to engage slots formed in the sides of the luminaire. The one piece housing is made possible by forming coupling features in the interfacing sides of the side panels. The tab slotted in a second tab structure is particularly useful in this regard. The hooked ends of the frame, in combination with the housing slots eliminates the need for expensive hinges. The combination of the hinging feature with the use of plastic material for latches, allows insertable latches to be snapped in holes appropriately formed and positioned on the frame without requiring the use of separate fasteners. The combination makes it possible to have a frame with no fasteners for either hinging or latching. Minimum assembly is then needed to assemble the luminaire.

The preferred embodiment of the luminaire uses vertical luminaire housing sides instead of the conventional slanted sides. Vertical sides allows a lamp ballast or similar control elements to be placed on one side of the enclosure thus permitting the same housing to accommodate from one to four fluorescent lamps without the need to change housing. The use of vertical side panels increases the enclosed volume, and placement of the ballast on the sides similarly permits the expanded housing to be used for lamp applications with from one to four enclosed lamps. An added advantage of the luminaire is that placing the ballast on the side of the compartment improves heat transfer The ballast then operates at a lower temperature, and should have a longer life. The lamp may include a mounting means 500 for mounting a fluorescent lamp in the partially enclosed volume coupled to the housing, electrical operating means 502 for operating a fluorescent lamp ballast mechanically coupled to the housing, and electrically coupled to the lamp mounting means, and electrical connection means 504 for electrically coupling the operating means to a power source. The inclusion of the lamps, lamp couplings, electrical connections, and lamp control devices is felt to be well within the skill in the art, and therefore unnecessary to discuss.

Different trims may be used around the same housing, and thereby eliminate the need for different housings for different applications, such as ceiling, and dry wall applications. The preferred luminaire uses a ceiling trim design that may be adapted for mounting as a dry wall unit without redesign. The luminaire housing may then be fitted to a coupling frame that in turn fits a standard hole as made in a stud and dry wall type wall. The luminaire is also not limited to a recessed luminaire using plastic lenses but is equally useful for a luminaire using louvers of various types.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A recessed fluorescent luminaire housing comprising:

a) a single piece housing blank having an inside surface and an opposite outside surface, further including i) a rectangular back panel having in sequence a first, second, third and fourth edge with the first edge and third edge being parallel and on opposite sides of the back panel, and the second edge and fourth edge being parallel and on opposite sides of the back panel, ii) first, second, third, and fourth, substantially rectangular, side panels, coextensively coupled with the back panel along the respective first, second, third and fourth edges, the first side panel having first width edge, and the second side panel having a second width edge adjacent the first side panel along the first width edge, iii) a first coupling means formed in the first side panel along the first width edge, iv) a second coupling means formed in the second side panel along the second width edge, so located to couple with the first coupling means of the paired first width edge, the side panels being folded along the respective back panel edges toward the inside surface of the back panel to form an angle to the back panel, and couple the adjacent first coupling means and second coupling means one to another, and the remaining adjacent side panel pairs being folded towards the inside surface of the back panel, and coupled along adjacent free edges of the adjacent side panels to define a partially enclosed volume useful as a luminaire housing.

2. A recessed fluorescent luminaire comprising:

a) a single piece housing having an inside surface and an opposite outside surface, further including i) a rectangular back panel having in sequence a first, second, third and fourth edges with the first edge and third edge being parallel and on opposite sides of the back panel, and second edge and fourth edge being parallel and on opposite sides of the back panel, ii) first, second, third, and fourth, substantially rectangular, side panels, coextensively coupled with the back panel along the respective first, second, third and fourth edges, the first side panel having first width edge, and a second side panel having second width edge adjacent the first side panel along the first width edge, iii) a first coupling means formed in the first side panel along the first width edge, iv) a second coupling means formed in the second side panel along the second width edge, so located to coupled with the first coupling means of the paired first width edge, the side panels being folded along the respective seams toward the inside surface of the back panel to form an angle to the back panel, allowing the adjacent first width edge and second width edge to coupled one to another, and otherwise coupling the remaining adjacent side panel pairs thereby defining a partially enclosed volume luminaire housing, b) a frame hinged to one of said side panels holding a lens panel to enclose the volume of the luminaire housing, c) a mounting means for mounting a fluorescent lamp in the partially enclosed volume coupled to the housing, d) electrical operating means for operating a fluorescent lamp mechanically coupled to the housing, and electrically coupled to the lamp mounting means, and e) electrical connection means for electrically coupling the operating means to a power source.

3. The luminaire housing of claim 1, wherein the first coupling means is a first tab, and the second coupling means is a first tab receptacle.

4. The luminaire housing of claim 3, wherein the first tab receptacle is formed by a slot positioned to receive the first tab, the first tab inserted in the slot, and bent to prevent withdrawal.

5. The luminaire housing of claim 4, wherein the first tab is positioned adjacent the second side panel, along the outside surface to prevent the second side panel from moving away from the enclosed volume.

6. The luminaire housing of claim 4, wherein the first tab receptacle is formed in a second tab positioned to receive the first tab, the first tab inserted in the slot and bent to prevent withdrawal.

7. The luminaire housing of claim 4, wherein the second tab is positioned adjacent the first side panel, along the outside surface to prevent the first side panel from moving away from the enclosed volume.

8. The luminaire housing of claim 4, wherein the slot is closely fitted to the first tab to prevent motion of the first tab transverse to the direction the first tab extends away from the first side panel.

9. The luminaire housing of claim 4, wherein a third tab extends from the width edge of the the slot is closely fitted to the first tab to prevent motion of the first tab transverse to the direction the first tab extends away from the first side panel.

10. A recessed fluorescent luminaire comprising:

a) a single piece housing having an inside surface and an opposite outside surface, further including i) a rectangular back panel having in sequence a first, second, third and fourth edges with the first edge and third edge being parallel and on opposite sides of the back panel, and second edge and fourth edge being parallel and on opposite sides of the back panel, ii) a substantially rectangular first side panel, having an edge coextensive with and forming a first seam with the back panel along the first edge, having a first width edge forming an angle with the first seam and having a first tab extending from the first width edge, and a second width edge forming an angle with the first seam and having a second tab extending from the second width edge, the first side panel being folded along the first edge toward the inside surface of the back panel to form an angle to the back panel, iii) a substantially rectangular second side panel, having an edge coextensive with and forming a second seam with the back panel along the second edge, having a first width edge forming and angle with the second seam and having a first tab receptacle, and a second length edge forming and angle with the second seam and having a second tab receptacle, the second side panel being folded along the second edge toward the inside surface of the back panel to form an angle to the back panel, allowing the second tab of the first side panel to couple with the first tab receptacle of the second side panel thereby holding the first side panel adjacent the second side panel, and the third tab extension to couple with the third tab receptacle, iv) a substantially rectangular third side panel, parallel and forming a seam with the back panel along the third edge, having a third width edge having a third tab extension, and a fourth width edge having a fourth tab extension, the third side panel being folded along the third length edge toward the inside surface of the back panel to form an angle to the back panel, v) a substantially rectangular fourth side, parallel and forming a seam with the back panel along the fourth edge, having a third length edge having a fourth tab receptacle, and a fourth length edge having a first tab receptacle, the fourth side panel being folded along the fourth edge toward the inside surface of the back panel to form an angle to the back panel, allowing the first tab extension to couple with the first tab receptacle, and the fourth tab extension to couple with the fourth tab receptacle, thereby defining a partially enclosed volume, b) a frame hinged to one of said side panels holding a lens panel to enclose the volume of the luminaire housing, c) a mounting means for mounting a fluorescent lamp in the partially enclosed volume coupled to the housing, d) electrical operating means for operating a fluorescent lamp mechanically coupled to the housing, and electrically coupled to the lamp mounting means, and e) electrical connection means for electrically coupling the operating means to a power source.

* * * * *